US011759971B2

(12) United States Patent
Kraft et al.

(10) Patent No.: US 11,759,971 B2
(45) Date of Patent: Sep. 19, 2023

(54) METHOD FOR PRODUCING A VENEER FROM RATTAN, VENEER SHEET, AND MOLDED COMPONENT

(71) Applicant: OUT FOR SPACE GMBH, Kisslegg (DE)

(72) Inventors: Peter Kraft, Kisslegg (DE); Julian Reuter, Wolfegg/Roetenbach (DE); Moritz Koehn, Kisslegg (DE); Felix Wurster, Kisslegg (DE)

(73) Assignee: OFS—BETEILIGUNGS—GMBH HOLDING, Kisslegg (DE)

( * ) Notice: Subject to any disclaimer, the term of this patent is extended or adjusted under 35 U.S.C. 154(b) by 279 days.

(21) Appl. No.: 16/605,184

(22) PCT Filed: Apr. 13, 2018

(86) PCT No.: PCT/DE2018/000102
§ 371 (c)(1),
(2) Date: Oct. 14, 2019

(87) PCT Pub. No.: WO2018/188680
PCT Pub. Date: Oct. 18, 2018

(65) Prior Publication Data

US 2021/0129373 A1 May 6, 2021

(30) Foreign Application Priority Data

Apr. 13, 2017 (DE) ..... 10 2017 003 643.8

(51) Int. Cl.
*B27L 5/00* (2006.01)
*B27J 1/00* (2006.01)

(52) U.S. Cl.
CPC .. *B27L 5/00* (2013.01); *B27J 1/00* (2013.01)

(58) Field of Classification Search
CPC ..... B27L 5/00; B27L 5/02; B27L 5/08; B27J 1/00; B27J 1/003; B27J 7/00
See application file for complete search history.

(56) References Cited

U.S. PATENT DOCUMENTS 178,949 A * 6/1876 Penley ..... A61F 13/00038 442/269
4,473,605 A * 9/1984 Rausch ..... A47B 95/00 144/353

(Continued)

FOREIGN PATENT DOCUMENTS

CH 210249 A 6/1940
CH 210249 A * 6/1940

(Continued)

OTHER PUBLICATIONS

Sullivan, Stan; "How to Cut a Board to Length w/ Angles—A Beginner Tutorial;" Jan. 13, 2016; YouTube; URL: https://youtu.be/yMPF40sExcM (Year: 2016).*

(Continued)

*Primary Examiner* — Matthew Katcoff
*Assistant Examiner* — Mohammed S. Alawadi
(74) *Attorney, Agent, or Firm* — BROOKS KUSHMAN PC; John E. Nemazi

(57) ABSTRACT

A method for producing a veneer in the form of a veneer sheet, wherein the method includes the following method steps: a) providing a plurality of rattan rods having tubules extending longitudinally, b) producing profiles from the plurality of rattan rods, the tubules extending in the longitudinal direction of the profiles, c) connecting the profiles to form a main body, wherein the profiles are arranged within the main body in such a way that the tubules extend in the longitudinal direction and/or transversely to the longitudinal direction and/or at a predefinable angle to the longitudinal direction of the main body, and d) cutting the main body (Continued)

produced in step c), the veneer sheet being obtained. A moulded component is also disclosed.

10 Claims, 6 Drawing Sheets

(56) References Cited

U.S. PATENT DOCUMENTS

| | | | | | |
|---|---|---|---|---|---|
| 4,810,551 | A | * | 3/1989 | Chu | B27J 1/003 428/106 |
| 5,456,964 | A | * | 10/1995 | Tamura | B27J 1/003 428/105 |
| 2021/0337995 | A1 | * | 11/2021 | Maurer | A47G 29/30 |

FOREIGN PATENT DOCUMENTS

| | | | | | |
|---|---|---|---|---|---|
| CN | 201483599 | U | * | 5/2010 | B27D 1/04 |
| CN | 201483599 | U | | 5/2010 | |
| CN | 102241040 | A | * | 11/2011 | |
| CN | 105756313 | A | | 7/2016 | |
| CN | 105756313 | A | * | 7/2016 | B27J 1/00 |
| DE | 2412881 | A1 | | 4/1975 | |
| DE | 19605525 | A1 | | 8/1997 | |
| DE | 20120158 | U1 | | 4/2002 | |
| DE | 102013019223 | A1 | | 5/2015 | |
| DE | 102013019223 | A1 | * | 5/2015 | B27K 3/04 |
| EP | 0047481 | A2 | * | 3/1982 | |
| GB | 1027627 | A | | 4/1966 | |
| TW | 200427559 | A | * | 12/2004 | B27L 5/00 |
| WO | 2014060413 | A1 | | 4/2014 | |
| WO | 2017021344 | A1 | | 2/2017 | |

OTHER PUBLICATIONS

English translate (CN102241040A), retrieved date Oct. 9, 2022.*
English translate (EP0047481A2), retrieved date Feb. 1, 2023.*
English translate (CH210249A), retrieved date Feb. 1, 2023.*
International Search Report, For PCTDE2018/000102, prepared by the European Patent Office, dated Jul. 24, 2018, 3 pages including the English translation.
Leroy Hurt: "Rattan for Sustainable Economic Development: A Case Study of Expanding Rattan's Design Potential through Technology Innovation", Global Humanitarian Technology Conference (GHTC), 2011, IEEE, IEEE, Oct. 30, 2011 (Oct. 30, 2011), pp. 323-327, XP032074411, DOI:10.1109/GHTC.2011.75 ISBN: 978-1-61284-634-7, p. 325.
PCT International Search Report for PCT/DE2018/000102 dated Jul. 16, 2018, 8 pages.

* cited by examiner

METHOD FOR PRODUCING A VENEER FROM RATTAN, VENEER SHEET, AND MOLDED COMPONENT

CROSS-REFERENCE TO RELATED APPLICATIONS

This application is the U.S. national phase of PCT Application No. PCT/DE2018/000102 filed on Apr. 13, 2018, which claims priority to DE Patent Application No. 10 2017 003 643.8 filed on Apr. 13, 2017, the disclosures of which are incorporated in their entirety by reference herein.

TECHNICAL FIELD

The invention relates to a method for producing a veneer from rattan, to a veneer sheet, to a molded component, and to the use of a veneer produced in such a manner.

BACKGROUND

Veneers are usually made from wood and are used as decorative components or trim parts in various applications. Veneers can serve as a decorative coating or as inlay work of, for example, items of furniture or musical instruments. However, veneers in the most various design embodiments and diverse surfaces can also be used as decorative elements in housings of electronic apparatuses or as an interior trim of vehicles. A desired, in particular sophisticated, impression is to be generated in the case of an object on account of the use of a veneer by way of a corresponding choice of the type of wood as well as by way of corresponding visual appearance of the wood. The selection of the wood in terms of the surface characteristic and color proves to be very complex and expensive in the individual design of veneers.

An item of furniture is known from DE 196 05 525 A1, wherein parts of the item of furniture are wrapped by fibrous strands from rattan.

DE 201 20 158 U1 discloses a braiding-material strip for producing planar braided products, wherein the braiding-material strips are composed of a veneer.

A method for producing a veneer is from CH 210249 A, wherein flat connection elements and tubular elements are joined in an alternating manner so as to form a block and subsequently are cut transversely to the alignment of the tubular elements.

The production of a block from a plurality of boards is known from WO 2017/021344.

WO 2014/060413 A1 describes a method for producing a multiple veneer/wood layer, wherein a plurality of peeled veneers are adhesively bonded on top of one another and are cut perpendicularly to an adhesive layer.

A wood veneer which is composed of a plurality of wood strips that are adhesively bonded to one another at the abutting edges is known from DE 2412881 A1.

SUMMARY

It is an object of the invention to specify a method by way of which the production of an individual veneer is performed in a simpler and more cost-effective manner. Further objects lie in specifying a veneer sheet, a planar component, as well as a use for such a veneer sheet, or planar component, respectively.

These objects are achieved by the features of the independent patent claims. Advantageous design embodiments of the invention are the subject matter of dependent claims.

The method according to the invention for producing a veneer in the form of a veneer sheet is distinguished by the following method steps:

- providing a plurality of rattan rods having longitudinally running tubes;
- generating profiles from the plurality of rattan rods, wherein the tubes extend in the longitudinal direction of the profiles;
- joining the profiles so as to form a primary element, wherein the profiles within the primary element are disposed in such a manner that the tubes extend in the longitudinal direction and/or transversely to the longitudinal direction and/or at a predefinable angle to the longitudinal direction of the primary element;
- cutting the primary element established in step c), wherein said veneer sheet is obtained.

A primary element hereunder is understood to be a board or a block. In the case of a board, the profiles herein are disposed beside one another in a single layer or ply, respectively. In the case of a block, the profiles are disposed beside one another and on top of one another in a plurality of layers or plies, respectively.

The term cutting in step d) is understood hereunder to be any type of mechanically severing of a veneer sheet from the primary element, this in particular being understood hereunder as sawing, blade cutting, laser cutting, or water-jet cutting.

The term profile in step b) hereunder is to be understood to be a profiled lumber of arbitrary length from rattan, having an arbitrary cross-section, in particular a square, rectangular, polygonal, or round cross-section. The profile lumber herein is produced from the solid material of a rattan rod. A primary element described in step c) can hereunder have a square, rectangular, polygonal, or round cross-section. The profile is in particular harvested from the core material of the rattan rod.

As opposed to bamboo, which is hollow in the core, a rattan rod is a solid material and along the entire diameter possesses tubes that run in the longitudinal direction. Bamboo does indeed likewise have a tube that runs in the longitudinal direction. However, said tube at the nodes of the bamboo is subdivided by a transverse wall (diaphragm). Bamboo thus does not have a tube that runs continuously in the longitudinal direction. A tube hereunder is thus understood to be a tube which runs substantially along the entire length of the profile, or the rattan rod, respectively.

The joining of the profiles so as to form a primary element described in step c) can be performed by adhesive bonding and/or pressing. Neighboring profiles can be glued to one another across the entire area, for example. However, it is also possible for the profiles be pressed so as to form a primary element. However, it is also possible for the individual profiles be able to be connected to one another so as to form a primary element by means of tongue-and-groove connections or dovetail connections. The primary element herein can have an arbitrary three-dimensional shape. As has already been described above, the primary element can be a board formed as a single ply from profiles, or a block formed as multiple plies from profiles. The adhesive is in particular a temperature-resistant and moisture-resistant adhesive.

By way of the method according to the invention it is possible for individual veneer sheets to be produced in a simple and cost-effective manner. It can furthermore be ensured on account of the method that predefined patterns of the veneer are reproducible in terms of the production thereof. The method according to the invention uses rattan as the initial material.

Rattan is a product from the trunk of the rattan palm, which is harvested and further processed in the form of rattan rods. The rattan rod is composed of many small tubes which are aligned in the longitudinal direction of the trunk, thus the rattan rod. Rattan and woody tissues of the palms and other comparatively high-growing plants are not wood in the strict sense A veneer hereunder is understood to be a thin cover layer which is suitable to be applied to a product be finished. The veneer is present in particular in the form of a veneer sheet.

As has already been described above, the profiles can have a triangular, quadrangular (square or rectangular) or hexagonal cross-section, for example. The profiles can expediently have a cross-section such that no cavities are created between the profiles when the profiles are connected according to step c) so as to form a primary body.

The profiles used in step c) can be of dissimilar lengths and/or identical length. On account of the disposal of the profiles in step c), a primary element having an individual pattern can be established from tubes that run in different directions. On account thereof it is possible for veneer sheets which have a visual appearance similar to that of intarsia be produced.

The profiles can be profiles which have been harvested from untreated rattan rods, hereunder referred to as untreated profiles. However, it is also possible for the profiles to have been treated by a method known from DE 10 2013 019 223 A1. In the case of this method known from DE 10 2013 019 223 A1, tubes of a rattan rod are filled with a liquid. This material is referred to as Karuun®. A treated profile hereunder is thus be understood to be profile in which the tubes are filled with a liquid, for example a color or a resin.

It is in particular possible for the primary element generated in step c) to be constructed from treated and untreated profiles. The individual profiles from which the primary element is constructed are in particular of identical coloring.

In the case of a primary element to be constructed in the form of a block, in one embodiment of the invention boards having an upper side and the lower side can be produced in a step b1) from the profiles generated in step b). Subsequently, in step c) the boards produced in such a manner are joined so as to form a primary element (block). On account thereof, further advantages in terms of the production of individual veneers can be derived. For example, it is thus possible for a plurality of boards of dissimilar thicknesses or dissimilar colors be stacked on top of one another. The stacked boards can be joined to one another, for example adhesively bonded or compressed, or be connected to one another by means of known connection techniques.

It is possible in step b) herein for first boards and second boards to be produced, wherein the profiles in the case of the first boards are disposed in such a manner that the tubes run horizontally to the upper side and the lower side of the first board, and the profiles in the case of the second boards are disposed in such a manner that the tubes run perpendicularly to the upper side and the lower side of the second board. Of course, it is also possible in step b) for third boards be produced in which first tubes run horizontally to the upper and the lower side of the third board and second tubes run perpendicularly to the upper side and the lower side of the third board. The block-shaped primary element generated in step c) can be constructed from the first and/or second and/or third boards in an alternating manner, or in an arbitrary sequence thereof. On account thereof, primary elements having an individual pattern can be constructed.

In particular, a block-shaped primary element can be constructed from a plurality of plies of profiles and boards that are joined to one another. By contrast thereto, a board-shaped primary element is constructed from a single tier of profiles that are joined to one another.

Individual tubes of the rattan material used can be mutually aligned in a perpendicular manner in a primary element. However, it is also possible for a primary element to be constructed from profiles and/or boards in such a manner that all of the tubes within the primary element run in a mutually parallel manner.

In order for a veneer sheet to be produced, the cut in step d) can be performed in such a manner that the sectional plane runs at a predefinable angle, in particular between 0° and 90°, to the longitudinal direction and/or the transverse direction of the tubes in the primary element. The primary element generated in step c) can in particular have a preferred direction. The cut according to step d) in this instance can be performed at a pre-definable angle, in particular between 0° and 90°, to the preferred direction of the primary element. The preferred direction of the primary element is expediently the longitudinal axis of the primary element. The tubes in the primary element expediently run along the longitudinal axis of the primary element or so as to be perpendicular to said longitudinal axis.

The cut in step d) can be carried out in such a manner that the primary element during the cutting procedure is rotated about a rotation axis. A peeled veneer can be obtained on account thereof.

The cut according to step d) can be carried out in such a manner that the veneer sheet has a thickness between 0.3 and 10 mm.

In order for the cutting procedure in step d) be carried out, a tool having a lip angle of 9 to 16°, in particular 11 to 14°, is used. The cutting quality is improved on account thereof, and it is achieved that the cutting face, in particular in the region between the tubes, has fewer tears.

In one embodiment of the invention, in a step c1) material can be applied at least to a surface of the primary element that runs perpendicularly to a sectional plane. This material can be a coating or an additional board. Tearing and fraying of the veneer sheet in the peripheral region when cutting can be minimized or avoided by applying the material. Furthermore, the quality of the veneer sheet can be increased.

In a further step c2) the primary element can be connected to a holding device. Said holding device can be, for example, a board to which the primary element is attached.

Before the primary element is cut in step d), the primary element can be moisturized in a subsequent step c3). This moisturizing can be performed, for example, in a temperature-controlled liquid bath. The primary element herein can be watered in a water bath at a temperature between 60° and 95°, preferably between 70° and 85°. Said watering can expediently be performed over a period of 4 to 12 hours. A liquid bath herein is to be understood, on the one hand, that the primary element is completely surrounded by a wash of a liquid, for example water. On the other hand, this is also to be understood that the primary element is surrounded by a liquid vapor, for example water vapor, in a steam vessel. One advantage herein is that the veneer sheet curls to a lesser extent after step d). Furthermore, the surface of the veneer sheet is improved on account thereof, the surface in particular becoming smoother. Furthermore, the tear strength of the veneer sheet is improved.

In a step d1) the veneer sheet can expediently be dried.

In one embodiment of the invention, a veneer sheet obtained in step d) can be further processed or finished, respectively, in that the tubes are exposed. This can be achieved, for example, by brushing, sanding, blasting, compressed-air or laser processes.

In one further embodiment of the invention, a liquid, pulverulent or gaseous material can be incorporated in and/or applied to the tubes and/or the regions between the tubes of a veneer sheet obtained in step d), and/or the veneer sheet can be subjected to a heat treatment. The liquid herein can be, for example, stains, lacquers, waxes, resins, acids, or oils. As a pulverulent substance, meals of mineral, synthetic, metallic, or organic origin can be used, for example. As a gaseous substance, water vapor, nitrogen, argon, or carbon dioxide, can be used, for example. A heat treatment can be performed, for example, by means of firing, or in a temperature-controlled oven.

On account of these measures it is possible for the veneer sheet to be visually designed in an individual manner. Furthermore, it is possible for the tubes to be sealed, impregnated, or soaked by way of the incorporated material or the incorporated substances, respectively, such that mold growth is impeded. In terms of the external appearance of the veneer sheet it can be achieved that the surface of the veneer sheet appears to be smooth or to have open pores. The treatment can moreover lead to the veneer sheet being lightened in color when corresponding means, for example bleaching agents or stains, are used. Furthermore, pests within the tubes can be eliminated, for example by gassing with carbon dioxide. Finally, the veneer sheet can be rendered pliable, for example by using water vapor, so as to achieve an improved deformation capability.

In a further step e) a carrier material can be applied to the reverse side of a veneer sheet obtained in step d) or step d1), respectively, and/or a transparent layer can be applied to the visible side of veneer sheet of obtained in step d) or d1), respectively. A carrier material herein is to be understood to be a material which is suitable for the veneer sheet to be able to be applied to the surface of the material. The carrier material herein can be, for example, a non-woven, a textile, or a film. However, alternatively or additionally to a non-woven or a film, the carrier material can be an element having a two-dimensional or three-dimensional surface, for example a board or a surface of an item of furniture or of a vehicle interior trim. It is thus possible, for example, for one or a plurality of veneer sheets to be applied to a non-woven, for example be adhesively bonded thereto, and the assembly from the veneer sheet and the non-woven be subsequently applied, for example adhesively bonded, to the surface of a board, for example a furniture table or a user surface of a vehicle. Additionally, a higher stiffness of the veneer sheet can additionally be achieved by way of a carrier material that is applied to the reverse side of the veneer sheet.

However, it is also possible that a plastics material is used as the carrier material. In an exemplary manner, a veneer sheet can be applied to a non-woven, and the assembly from the veneer sheet and the non-woven can subsequently be overmolded with a plastics material on one side or on the non-woven side. It is thus possible for a molded part which has a desired physical design and at least on a surface has a layer from a non-woven and a veneer sheet to be achieved in a pressure-molding for injection-molding method.

In one further design embodiment of the invention a transparent layer can be applied to the visible side of the veneer sheet. The weather resistance can be improved by way of said layer, for example, but it is also possible for the surface of the veneer sheet to be imparted a desired haptic property. Furthermore, a desired visual effect can be achieved by applying a layer. The application of the layer can be performed by means of adhesive methods as well as by means of printing, in particular 3D printing methods. By means of 3D printing methods it is possible for a pattern be printed onto the visible surface of a three-dimensionally deformed veneer sheet.

A further aspect of the invention relates to the specification of a molded component formed from at least one veneer sheet which is produced according to the method according to the invention. A molded component is also be understood to be a planar component. Said planar component or molded component, respectively, according to the invention is distinguished in that a plurality of veneer sheets are stacked on top of one another and connected to one another. On account thereof, the planar component or molded component, respectively, is imparted an increased stiffness. A element having an arbitrary three-dimensional shape can be produced by stacking individual veneer sheets on top of one another.

However, it is possible for the veneer sheet produced by a method according to the invention be applied to a carrier material in order for the stiffness of the veneer sheet to be increased.

The veneer produced by the method according to the invention can be used in arbitrary applications. For example, the veneer can be used in the interior and/or exterior region of a vehicle. The interior region can be, for example, a passenger cabin of the vehicle. The use of the veneer in a trunk or a glovebox, respectively, of the vehicle is also imaginable. The use of the veneer in the vehicle leads to a more sophisticated appearance, or an enhancement, of the vehicle, respectively. The production costs of the vehicle can be reduced by using the high-quality but cost-effective raw material rattan. Moreover, individual planar components can be provided on account thereof, so that the vehicle can be designed in an individual manner. Furthermore, quasi-identical planar components can be provided so as to provide dissimilar vehicles with the same planar components. Furthermore, planar components produced in an identical manner can be used as spare parts.

A veneer sheet which has been produced according to the method according to the invention can be used on surfaces of items of furniture, household items, or utensils.

BRIEF DESCRIPTION OF THE DRAWINGS

The invention will be explained in more detail hereunder by means of figures in which.

DETAILED DESCRIPTION

Figure 1:
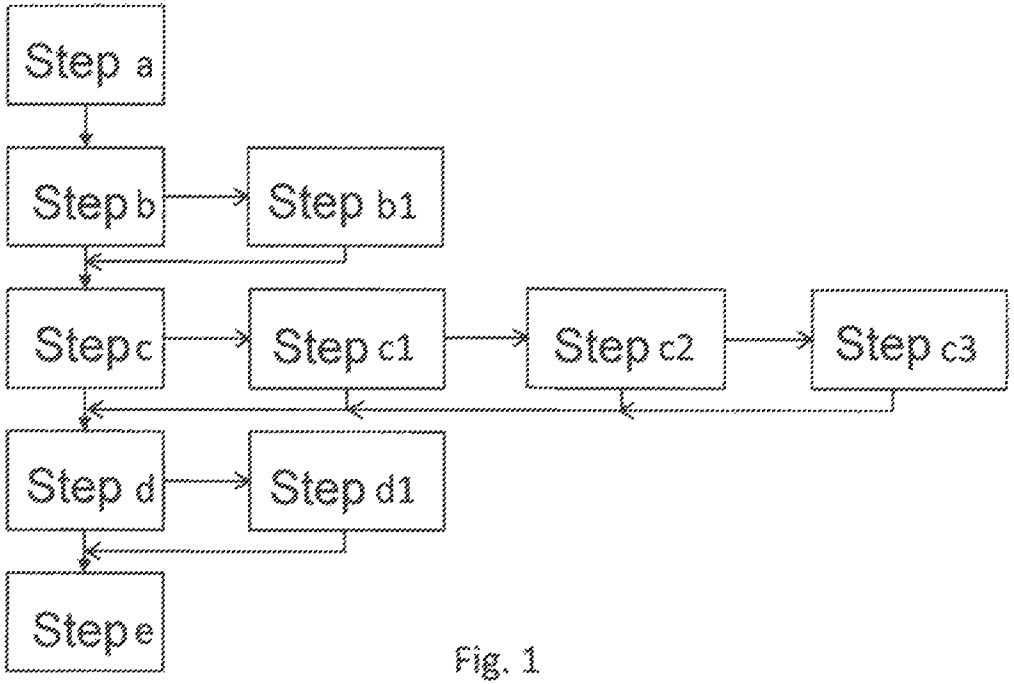
FIG. 1 shows the sequence of the method according to the invention.

FIG. 1 shows a flow diagram of the method according to the invention. In step a) rattan rods having longitudinally running tubes are provided. The rattan rods can be rattan rods from raw rattan material. However, said rattan rods can also be rattan rods which have been treated by means of a liquid. The tubes herein are completely or partially filled with a liquid.

In step b) profiles 3 are subsequently generated from said rattan rods, wherein the tubes 4 extend in the longitudinal direction of the profiles 3. The rattan rods herein are processed in such a manner that the profiles 3 have a predefined cross-section, for example a triangular, quadrangular, or hexagonal cross-section. The profiles 3 herein have a direction of extent in the longitudinal direction of the tubes 4. In a step b1) boards 2 can subsequently be produced from the profiles 3 produced in step b).

Subsequently, in step c) the profiles 3 produced in step b), or the boards 2 generated in step b1), respectively, are processed so as to form a primary element 1. The profiles 3 or boards 2, respectively, are expediently joined to one another, for example adhesively bonded or compressed. To this end, the profiles 3 or boards 2, respectively, are mutually disposed in a predefined direction in order for the primary element 1 to be formed. Neighboring profiles 3 or boards 2, respectively, herein are disposed in such a manner that the tubes 4 run in a mutually parallel and/or perpendicular manner. Alternatively or additionally, however it is possible for the profiles 3 be mutually disposed in such a manner that the tubes 4 have a predefined mutual angle.

In an optional step c1) a material 7 can be applied to a surface of the primary element 1 that runs perpendicular to a sectional plane S, S1, S2. It is prevented on account thereof that in the event of a cut in the direction of the arrow (FIG. 2) the surface 1*a* of the primary element 1 on which the material 7 bears is frayed or torn, respectively, on account of the cutting procedure. In a further optional step c2) the primary element 1 can be incorporated in a holding device. In an optional step c3) the primary element 1 can subsequently be moisturized. This moisturization can be performed, for example, in a temperature-controlled liquid bath or in a steam environment.

In a step d) the primary elements established in step c) are cut or sawn. Veneer sheets are generated on account thereof. The thickness of the veneer sheets herein can be set to 0.3 mm to 10 mm. Of course, greater or lesser thicknesses are also possible. In an optional step d1) the veneer sheets are dried.

The veneer sheets produced can be further processed in a step e). For example, a plurality of veneer sheets herein can be connected to one another in the form of a stack. However, it is also possible for the veneer sheets on the visible side to be coated with a transparent or semi-transparent cover layer. The veneer sheets can however also be additionally constructed so as to have a reinforcement layer on the reverse side.

It is to be pointed out here that the treatment of the rattan rods with a liquid described in step a) can alternatively also take place in step b) in such a manner that the profiles generated are treated with the liquid in step b). Alternatively, the treatment with a liquid can also take place in step c) in such a manner that the primary element constructed from the profiles generated is treated with liquid.

Figure 2:
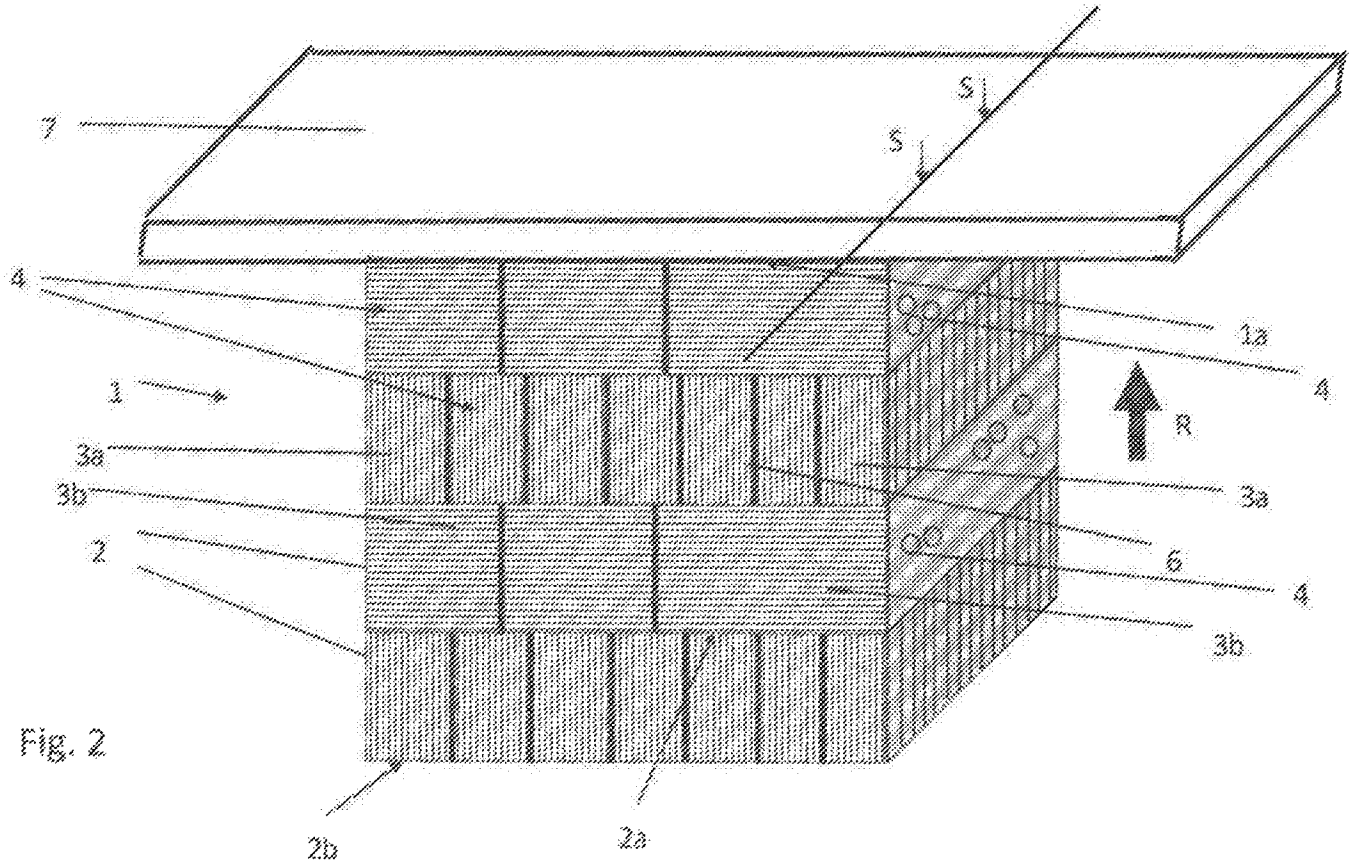
FIG. 2 shows a first exemplary illustration of a block-shaped primary element generated in step c), in a front view.

FIG. 2 in a perspective view shows a first exemplary illustration of a primary element generated in step c). The primary element 1 herein is constructed from a plurality of boards 2 that are stacked on top of one another. Each board 2 is composed of a plurality of profiles 3*a*, 3*b*. The tubes 4 in the profiles 3*a*, 3*b* run in each case in a mutually parallel manner in the longitudinal direction of the profiles 3. The boards 2 are in each case formed from a plurality of profiles 3*a*, 3*b* that are disposed beside one another. The tubes 4 within a board 2 in an exemplary manner run so as to be parallel (in the profiles 3*b*) or perpendicular (in the profiles 3*a*) to the upper side 2*a* or the lower side 2*b* of the board 2. The profiles 3*a*, 3*b* in an exemplary manner are glued to one another at the connection faces 6. Neighboring boards 2 are in each case glued to one another on the upper side 2*a* and the lower side 2*b*.

The primary element 1 has a surface 1*a*. A material 7, for example a board, is attached to said surface 1*a* of the primary element 1. Said material 7 can be adhesively bonded to the primary element 1. However, it is also possible for said material 7 to be releasably clamped with the primary element 1. The primary element 1 has a sectional plane S. Said sectional plane S runs perpendicularly to the material 7. The cutting direction is indicated by the direction of the arrow in FIG. 2. A cut is thus guided along the direction of the arrow R through the block 1 in the direction of the material 7. The fraying or tearing, respectively, of the surface 1*a* is thus minimized or avoided, respectively, in the cutting procedure in step d).

Figure 3:
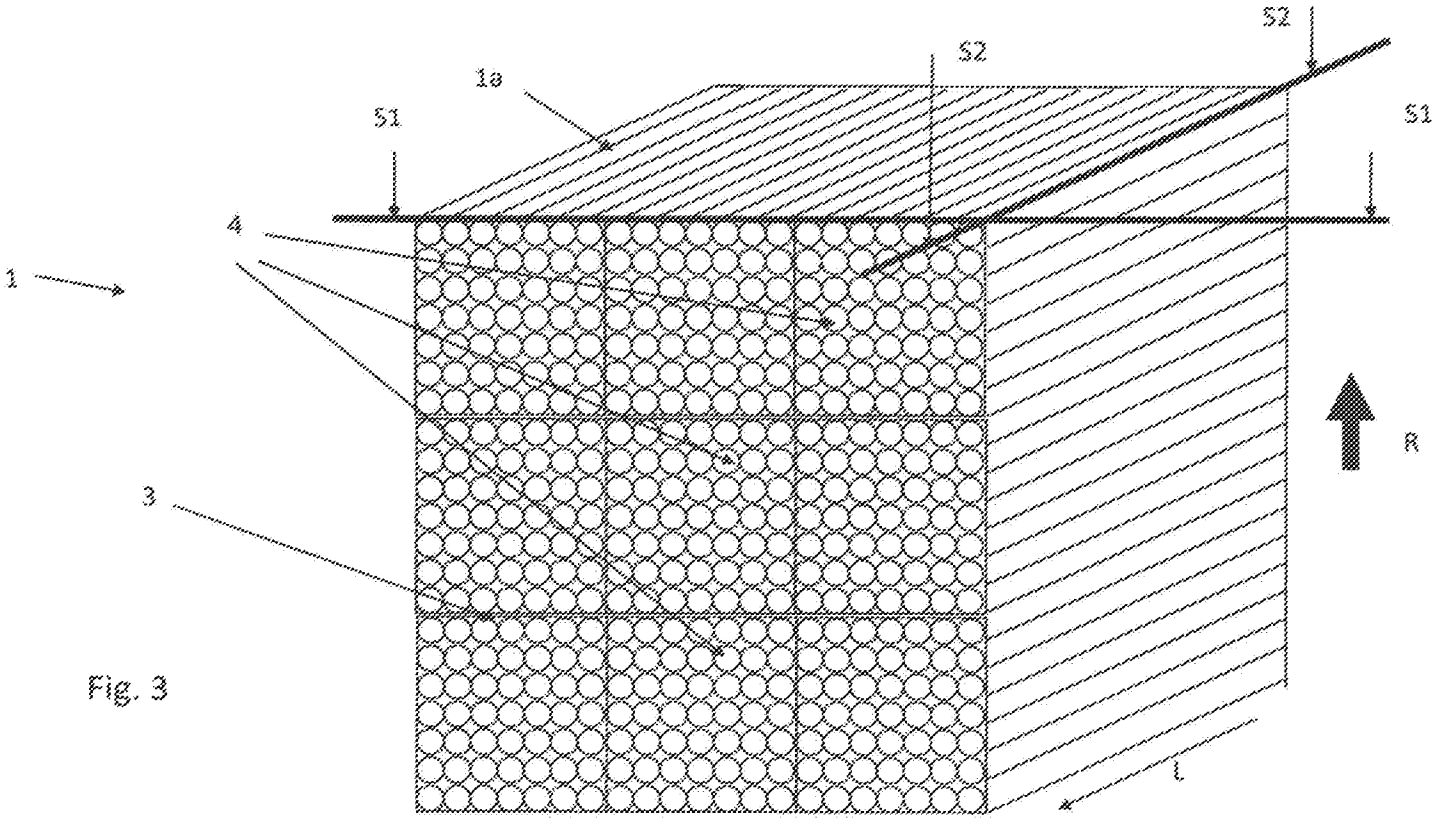
FIG. 3 shows a second exemplary illustration of a block-shaped primary element generated in step c), in a front view.

FIG. 3 in a perspective view shows a second exemplary illustration of a block-shaped primary element generated in step c). By contrast to the first primary element 1 according to FIG. 2, all of the tubes 4 in the profiles 3 in the primary element 1 illustrated in FIG. 3 are aligned so as to be mutually parallel. For reasons of clarity, the material 7 on the surface 1*a* of the primary element 1 is not illustrated in FIG. 3. FIG. 3 shows two sectional planes S1, S2. The sectional plane S1 runs perpendicularly to the longitudinal axis L of the tubes 4. The veneer sheet generated therefrom is also referred to as a grain-cut veneer. Said grain-cut veneer is distinguished in that it is permeable to light and sound. Said grain-cut veneer is thus suitable, for example, as a lampshade or as a cover for a loudspeaker. FIG. 3 furthermore shows a sectional plane S2 perpendicular to the sectional plane S1. This sectional plane S2 runs parallel to the longitudinal axis L of the tubes 4. A sectional plane which runs at a predefined angle to the sectional plane S1 or S2, respectively, is not plotted.

Figure 4:
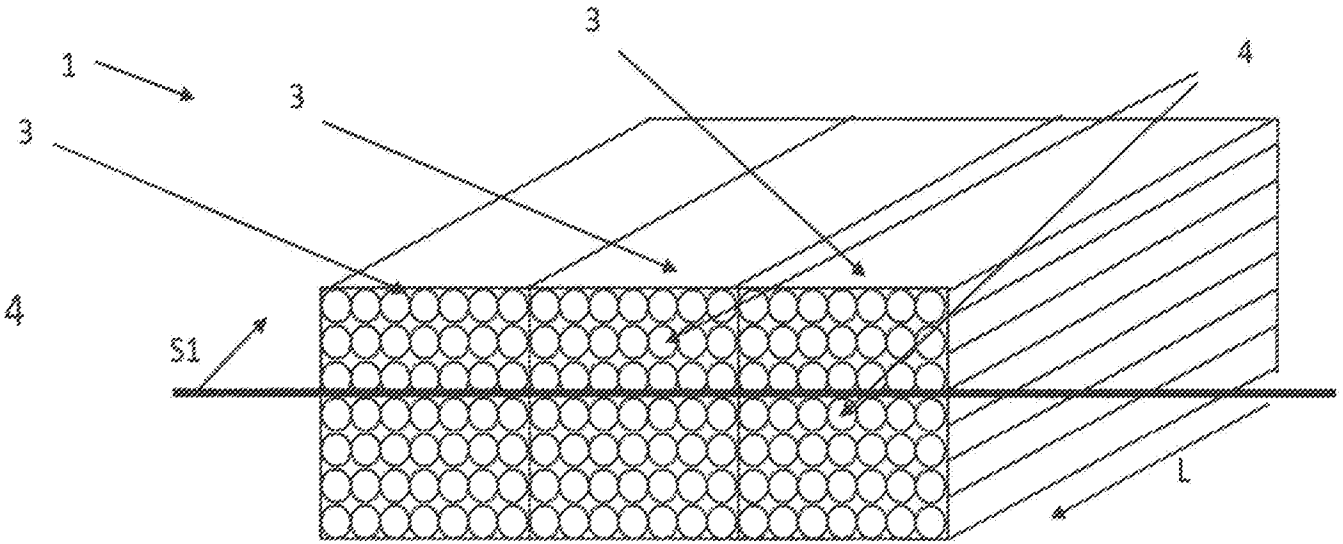
FIG. 4 shows an exemplary illustration of a board-shaped primary element generated in step c), in a front view.

FIG. 4 in a perspective view shows an exemplary illustration of a board-shaped primary element generated in step c). The primary element 1 in an exemplary manner is constructed from three profiles 3 that are disposed beside one another. The board-shaped primary element 1 extends in the longitudinal direction L. The sectional plane S1 runs along the longitudinal direction L. A veneer sheet is thus fabricated along the longitudinal direction of the individual tubes 4.

Figure 5:
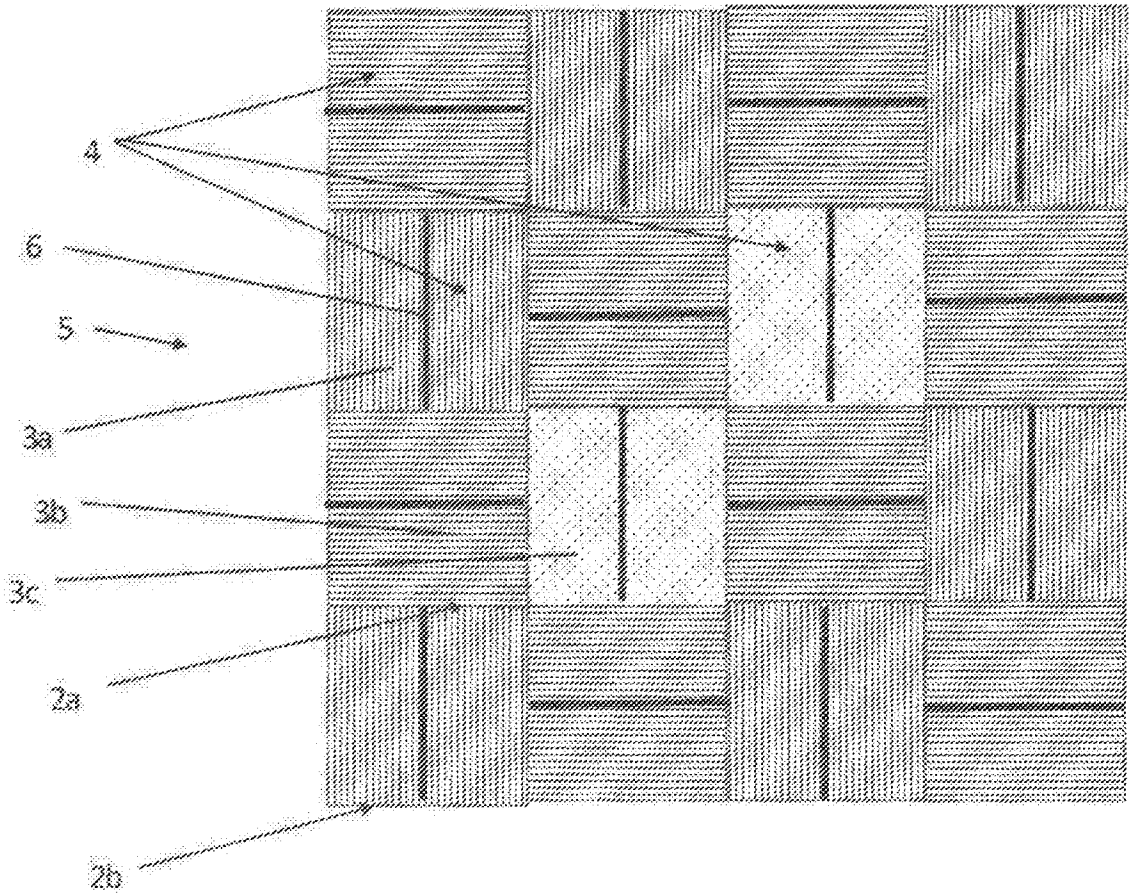
FIG. 5 shows an exemplary illustration of a third veneer sheet generated in step d)

FIG. 5 shows an exemplary illustration of a veneer sheet generated in step d), having an individual pattern of the tubes 4. The veneer sheet 5 is constructed from a plurality of profiles 3*a*, 3*b*, 3*c*. According to FIG. 2, the profiles 3*a* run in such a manner that the tubes 4 run perpendicularly to the upper side and the lower side 2*a*, 2*b* of the boards 2. To this end, the profiles 3*b* are disposed so as to be perpendicular, specifically in such a manner that the tubes 4 run parallel to the upper side and the lower side 2*a*, 2*b* of the boards 2. FIG. 3 shows additional profiles 3*c* which are disposed in such a manner that the tubes 4 run parallel to the upper side and the lower side 2*a*, 2*b* of the boards 2 and perpendicularly to the drawing plane.

Figure 6:
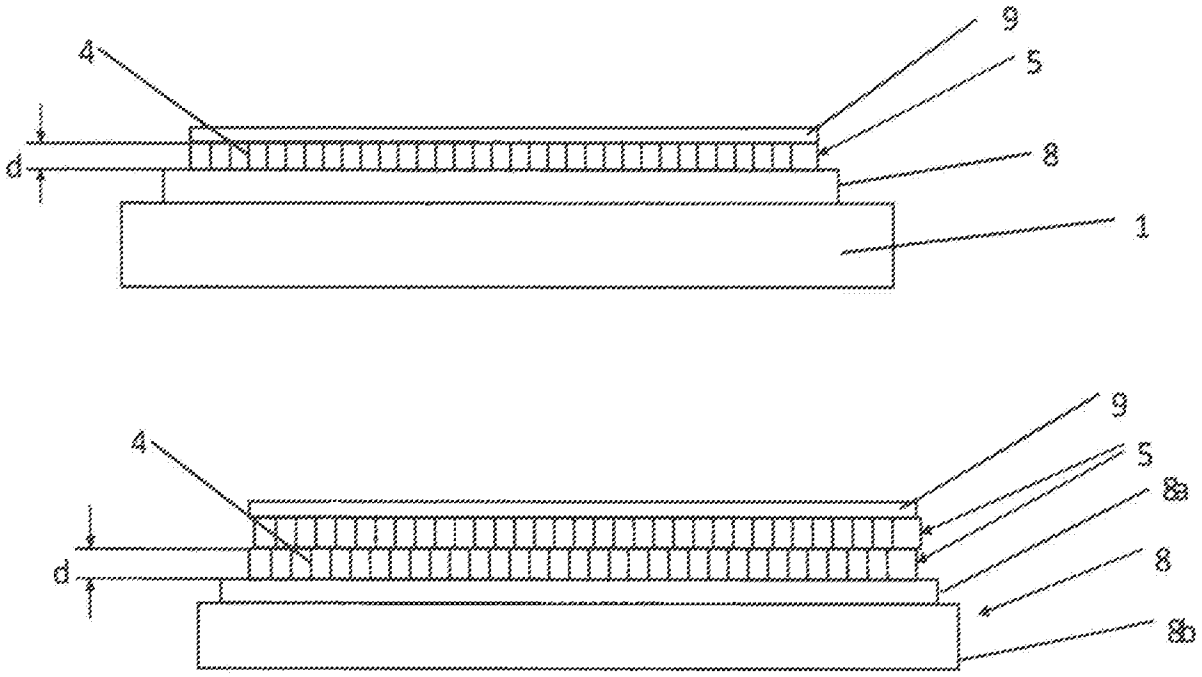
FIG. 6 shows an exemplary illustration of a veneer sheet from a primary element according to FIG. 3.

FIG. 6 in an upper and a lower picture shows an exemplary illustration of a veneer sheet from a primary element 1 according to FIG. 3 in a sectional illustration. The upper picture shows a veneer sheet 5 which has been cut from the primary element 1 according to FIG. 3 along the sectional plane S1. FIG. 6, upper picture, shows said veneer sheet 5 having a thickness d in a sectional illustration along the plane S2. The tubes 4 in the veneer sheet 5 are disposed so as to be mutually parallel. The veneer sheet 5 on the reverse side is applied to a carrier material 8. The carrier material 8 herein can be a non-woven or a board. The assembly from the veneer sheet 5 and the carrier material 8 is fastened to a mounting 10. A transparent layer 9 is applied to the visible face of the veneer sheet 5, that is to say on the surface of the veneer sheet 5 that is opposite the carrier material 8.

The lower picture shows an assembly from two veneer sheets 5 which are stacked on top of one another and are applied to a carrier material 8. A transparent layer 9 is supplied to the upper side of the upper veneer sheet 5. The carrier material 8 herein is composed of a non-woven, textile, or a film 8*a* which on the reverse side is applied to the stack of veneer sheets 5. The assembly from the veneer sheet stack 5 and the non-woven 8*a* is applied to a carrier 8*b*, for example a board.

LIST OF REFERENCE SIGNS

1 Primary element
1*a* Surface of primary element
2 Board
2*a* Upper side
2*b* Lower side
3*a* Profile
3*b* Profile
4 Tube
5 Veneer sheet
6 Connection face
7 Material
8 Carrier material
8*a* Non-woven/film
8*b* Carrier
9 Transparent layer
10 Mounting
S,
S1,
S2 Sectional plane
L Longitudinal axis of tube
R Cutting direction

The invention claimed is:

1. A method for producing a veneer in the form of a veneer sheet, comprising the following method steps:

a) providing a plurality of rattan rods having longitudinally running tubes;
b) generating profiles from the plurality of rattan rods, wherein the tubes extend in the longitudinal direction (L) of the profiles;
c) joining the profiles so as to form a primary element, wherein the profiles within the primary element are disposed in such a manner that the tubes extend in the longitudinal direction (L) of the primary element;
d) cutting the primary element established in step c), wherein veneer sheets are obtained and wherein the cut is performed in such a manner that a sectional plane (S1) runs at a transverse direction of the tubes in the primary element;
e) incorporating into the tubes of a veneer sheets obtained in step d) a pulverulent material; and
f) subjecting the veneer sheets and incorporated matter to a heat treatment.

2. The method as claimed in claim 1, wherein in step b) the profiles are formed into boards, and in step c) the boards produced are joined so as to form the primary element.

3. The method as claimed in claim 1, wherein the tubes of the rattan rods provided in step a) and/or the profiles generated in step b) and/or the primary elements generated in step c) are filled with a liquid.

4. The method as claimed in claim 1, wherein in step c) a material is applied at least to a surface of the primary element that runs perpendicularly to a sectional plane (S, S1, S2).

5. The method as claimed in claim 4, wherein in step c) the primary element is moisturized.

6. The method as claimed in claim 1, wherein the primary element in step c) is connected to a holding device.

7. The method as claimed in claim 1, wherein in step e) a carrier material is applied to the reverse side of the veneer sheet obtained in step d), and/or a transparent layer is applied to the visible side of a veneer sheet obtained in step d).

8. A veneer sheet which is produced by a method as claimed in claim 1, wherein the veneer sheet has a material thickness of 0.3 to 10 mm.

9. A molded component formed from at least one veneer sheet as claimed in claim 8, wherein a plurality of veneer sheets are stacked on top of one another or joined to one another.

10. A molded component formed from at least one veneer sheet as claimed in claim 8, wherein the veneer sheet is applied to a carrier material.

* * * * *